US005755616A

United States Patent [19]

Sanichar

[11] Patent Number: 5,755,616

[45] Date of Patent: May 26, 1998

[54] WALLBOARD SANDER

[76] Inventor: Elvin Sanichar, 157 Beacon Ave., Jersey City, N.J. 07036

[21] Appl. No.: 852,545

[22] Filed: May 7, 1997

[51] Int. Cl.[6] ..... B24D 15/02

[52] U.S. Cl. ..... 451/524; 451/453; 451/557; 451/359

[58] Field of Search ..... 451/524, 453, 451/557, 359

[56] References Cited

U.S. PATENT DOCUMENTS

| | | | |
|---|---|---|---|
| 3,432,975 | 3/1969 | Parker | 451/524 |
| 3,483,662 | 12/1969 | Ames | 451/524 |
| 3,964,213 | 6/1976 | Tobey | 451/524 |
| 4,759,155 | 7/1988 | Shaw | 451/524 |
| 4,937,984 | 7/1990 | Tarano | 451/524 |
| 5,283,988 | 2/1994 | Brown | 451/524 |
| 5,634,843 | 6/1997 | Liu | 451/524 |

*Primary Examiner*—Robert A. Rose
*Assistant Examiner*—George Nguyen
*Attorney, Agent, or Firm*—Charles I. Brodsky

[57] ABSTRACT

A manually operated sander especially useful in sanding dry wallboard ceilings including a bottom surface below an abrasive sanding screen of metallic mesh interstices, consisting of a plurality of perforations of much greater predetermined size, and predeterminedly spaced between its defining edges to allow dust particles to fall within a collecting chamber of which it forms a part, to be thereafter disposed of by accessing a hatch formed within the chamber. A pair of flaps of unequal length within the chamber serve to reduce spillage of the dust collected when the housing is tilted in being carried about.

13 Claims, 5 Drawing Sheets

WALLBOARD SANDER

FIELD OF THE INVENTION

This invention relates to wallboards, and, more particularly, to a manually operated sander for sanding dry wallboard compound from ceilings and collecting the residue dust therefrom.

BACKGROUND OF THE INVENTION

As is well known and understood, electrically operated sanders are available for sanding dry wallboard compounds from ceilings, utilizing a type of vacuum device for collecting the dust particles which wall during the process. As is also well known, such electrically operated sanders are purchased and used primarily by professionals working in the business, who are able to afford the cost thereof. Because of their relatively heavy weight (as compared to that of manually operated sanders), and because of their somewhat convoluted design, their use—even by a professional—is, of necessity, cumbersome and tiring.

As will be recognized, on the other hand, more and more homeowners and apartment dwellers are attending to their own remodeling and repair jobs these days as construction costs continue to spiral. Installation of track lighting, hanging new electric fixtures, and emplacing wall-mounted stereo speakers are now more-or-less common tasks undertaken by the homeowner, or apartment dweller, without bringing in a contractor or general handyman to do the work. As most of these remodelings, or repair situations are of a minor nature—as contrasted with putting up a new ceiling in a new home construction or room addition—, the cost of purchasing one of the available electrically operating sanders most oftentimes is not justified. Also, for the small contractor, or general handyman, the cost of purchasing such an electrically operated sander is not justified either. Thus, in those situations, the work is typically done utilizing a manually operated sander. However, as anyone who has attempted to do this type of remodeling or repair is aware of, utilizing a manually operated sander for ceiling work suffers the disadvantage that the dust particles generated fall by gravity onto the clothing of the worker, into his or her hair or eyes, onto the floor, onto any furniture, onto draperies, onto carpeting, or onto just about anything that may be present in the room. What with many homes having central air conditioning, furthermore, it is not unusual to then find these dust particles being carried by the ductwork from room-to-room.

OBJECTS OF THE INVENTION

It is an object of the present invention, therefore, to provide a new and improved wallboard sander which is especially attractive for manually operated use.

It is another object of the invention to provide such a wallboard sander which collects the dust particles otherwise falling by gravity.

It is also an object of the present invention to provide such a wallboard sander which is inexpensive to manufacture—and, therefore, able to be purchased by a user at a price that can be easily afforded.

SUMMARY OF THE INVENTION

As will become clear from the following, a preferred embodiment of the wallboard sander of the invention consists of a housing having top, bottom and opposing side surfaces to form a dust collecting chamber, with a hatch in one of its side surfaces for accessing dust particles that fall within through the manual operation of the sander in sanding dry wallboard ceilings. As will be seen, an abrasive sanding screen of metallic mesh interstices is utilized, held against the bottom surface of the housing, and with the bottom surface, according to the invention—including a plurality of apertures between the edges that define its shape. In the preferred embodiment illustrated, such apertures are selected of predetermined size, predeterminedly spaced about the bottom surface, and of a size many times greater than that of the mesh interstices. With a handle extending upwardly from the top surface of the housing, the wallboard sander is inverted for use in sanding ceilings, with the residual dust then falling through the metallic mesh interstices, and through the plurality of apertures, into the chamber of the housing, for later access through a hinged cover, in order to dispose of the dust residue particles.

As will also be described, the housing includes a pair of surfaces inwardly of the dust collecting chamber, angled upwardly from opposite ends of the bottom housing surface, at different angles, and being of different lengths. As the detailed description which follows sets forth, such arrangement of angled surfaces serves to reduce spillage of the dust collected when the housing is tilted in being carried about, or when manually used to sand dry wallboards aligned vertically. In the preferred construction set forth, furthermore, a wing-nut type of securing arrangement is employed on each of the opposing side surfaces of the manually operated wallboard sander of the invention, for alternately tightening and loosening the abrasive sanding screen when it is desired to clean the screen of any embedded dust particles, and/or in the replacement thereof.

BRIEF DESCRIPTION OF THE DRAWINGS

These and other features of the invention will be more clearly understood from a consideration of the following description, taken in connection with the accompanying drawings, in which.

DETAILED DESCRIPTION OF THE DRAWINGS

Figure 1:
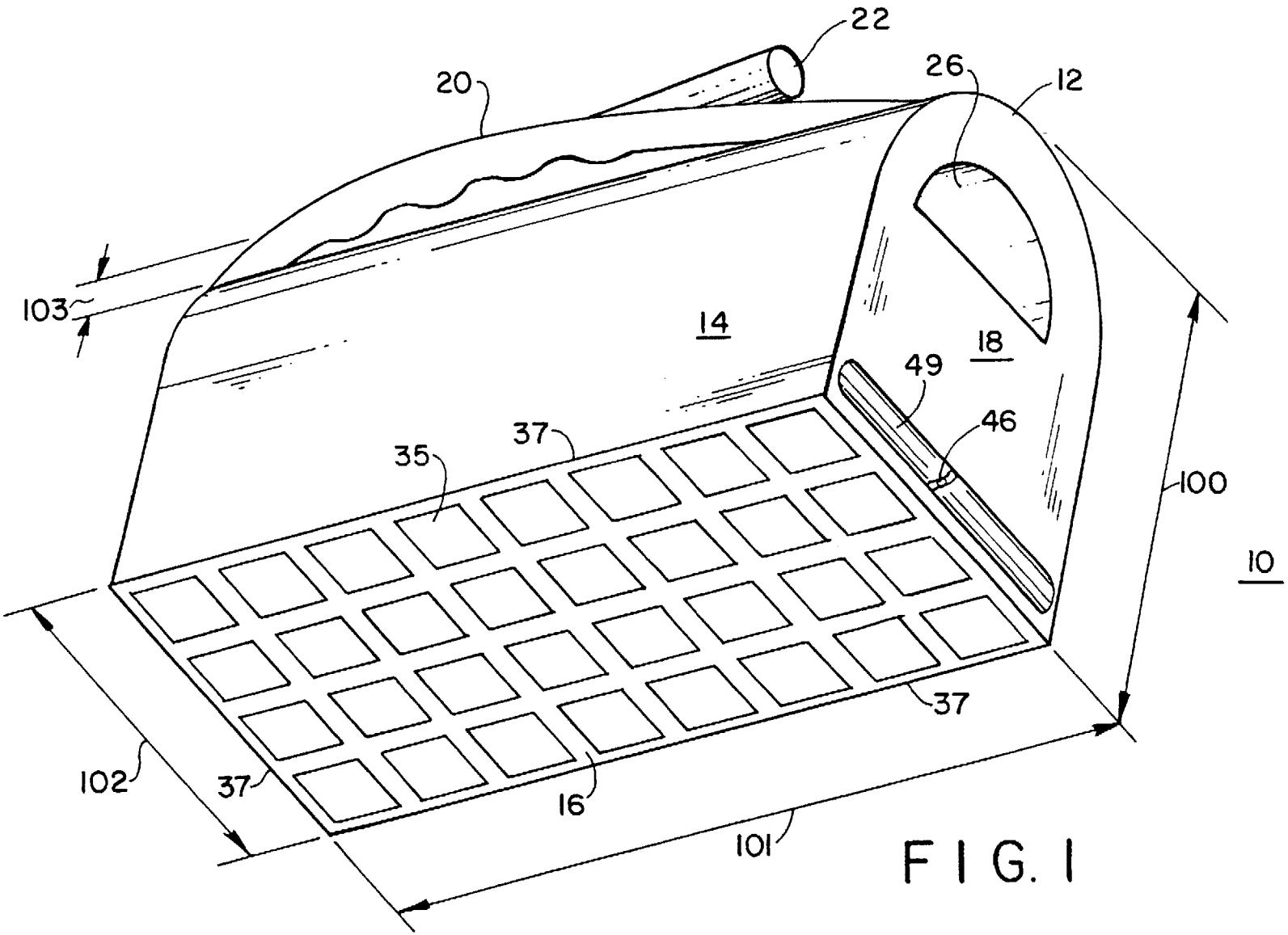
FIGS. 1 and 2 are perspective views helpful in understanding the manually operated wallboard sander of the invention.

In the drawings, the wallboard sander 10 incorporates a housing 12—preferably of a plastic composition—having opposing top and bottom surfaces 14, 16 and a pair of opposing side surfaces 18 forming a dust collecting chamber. A handle 20—also preferably of plastic composition—extends upwardly from, and cooperates with, the top surface 14 for carrying the housing 12 from place-to-place, and for tilting and orienting the housing for use in sanding wallboards, and particularly in sanding dry wallboard ceilings. As illustrated, the handle 20 is spaced apart from the top surface 14 of the housing 12 a sufficient distance along its length to permit its easy and convenient grasping in use. As also shown, the handle 20 includes a receptacle 22, of appropriate length, angled upwardly from the handle 20 (of the order of 40°, as an example) to permit its receiving an extension pole (not shown) inserted therein, for remote use in utilizing the wallboard sander to sand high ceilings. As will be appreciated by those skilled in the art, such ceilings may not be reachable from just standing on a floor, or on a stepladder, and is utilizable in a manner similar to the use of extension poles in changing light bulbs recessed into high ceiling fixtures.

Figure 2:
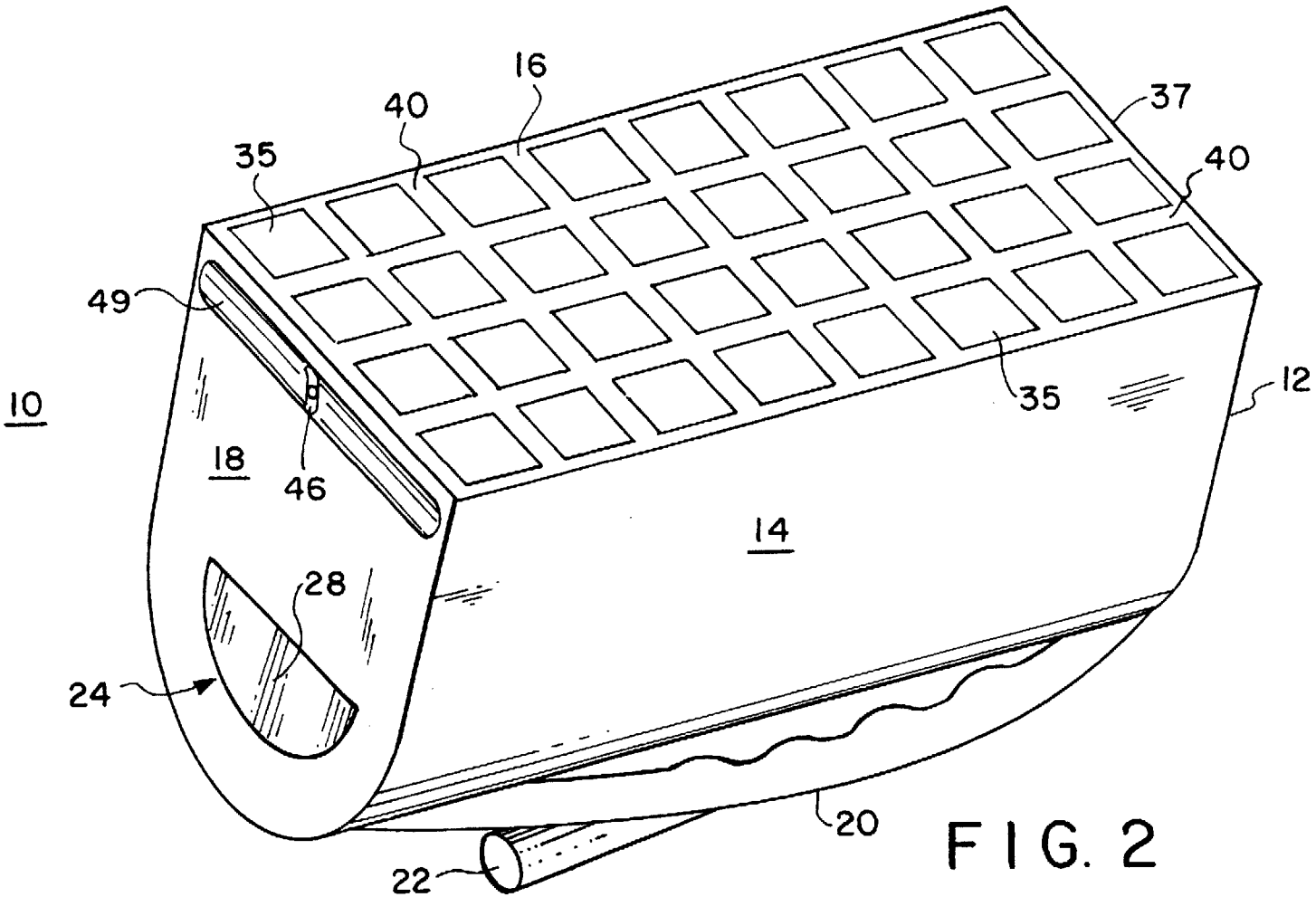
Figure 5A:
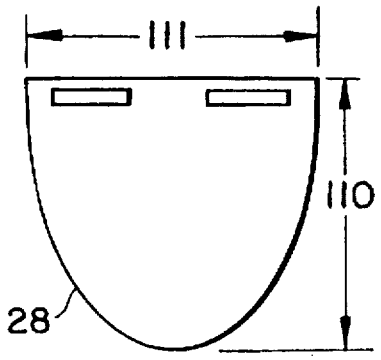
FIGS. 5*a*–5*c* are illustrations helpful in an understanding of the hingeable cover for gaining access to the dust collecting chamber of the sander of the invention.
Figure 5B:
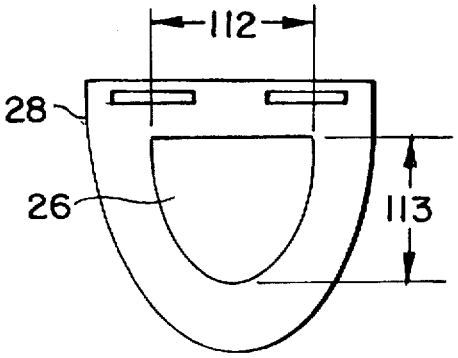
Figure 5C:
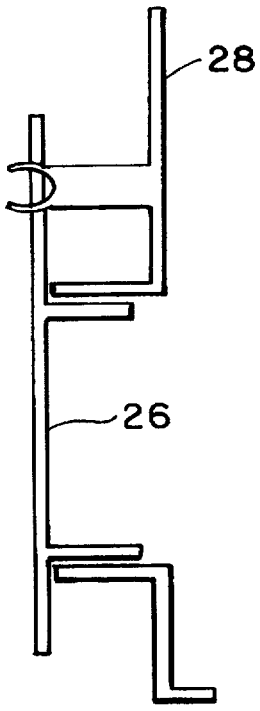

Also shown in FIGS. 1 and 2 is an arrangement on one of the opposing side surfaces 18 of the housing 12 for obtaining access into the housing to empty any dust that may collect within the chamber so formed during the use of the sander in operation. Indicated by the reference numeral 24 in FIG. 2, such arrangement includes an aperture 26 in one of the opposing side surfaces 18, and a cover 28 to open and close over the aperture 26 when access is desired. In this respect, it will be appreciated that the wallboard sander of FIG. 1 shows the access arrangement 24 with the cover 28 removed (so as to expose the aperture 26) whereas in FIG. 2, the cover 28 is in place over the aperture 26. FIG. 5*a* in this respect, illustrates the cover 28, while in FIG. 5*b*, a phantom view, the cover 28 is shown as it overlie the aperture 26 when closed. Such cover 28 may be affixed to the side surface 18 of the housing 12 in any appropriate manner, as by a hinge arrangement typified in a manner shown in FIG. 5*c*.

Whereas, except for the aperture 26 in the side surface 18, the top and side surfaces 14, 18 are devoid of any other perforations, the bottom surface 16 of the housing 12 includes a plurality of apertures 35 of predetermined size and predetermined position placed about the bottom surface between the edges 37 which define its shape.

Figure 3:
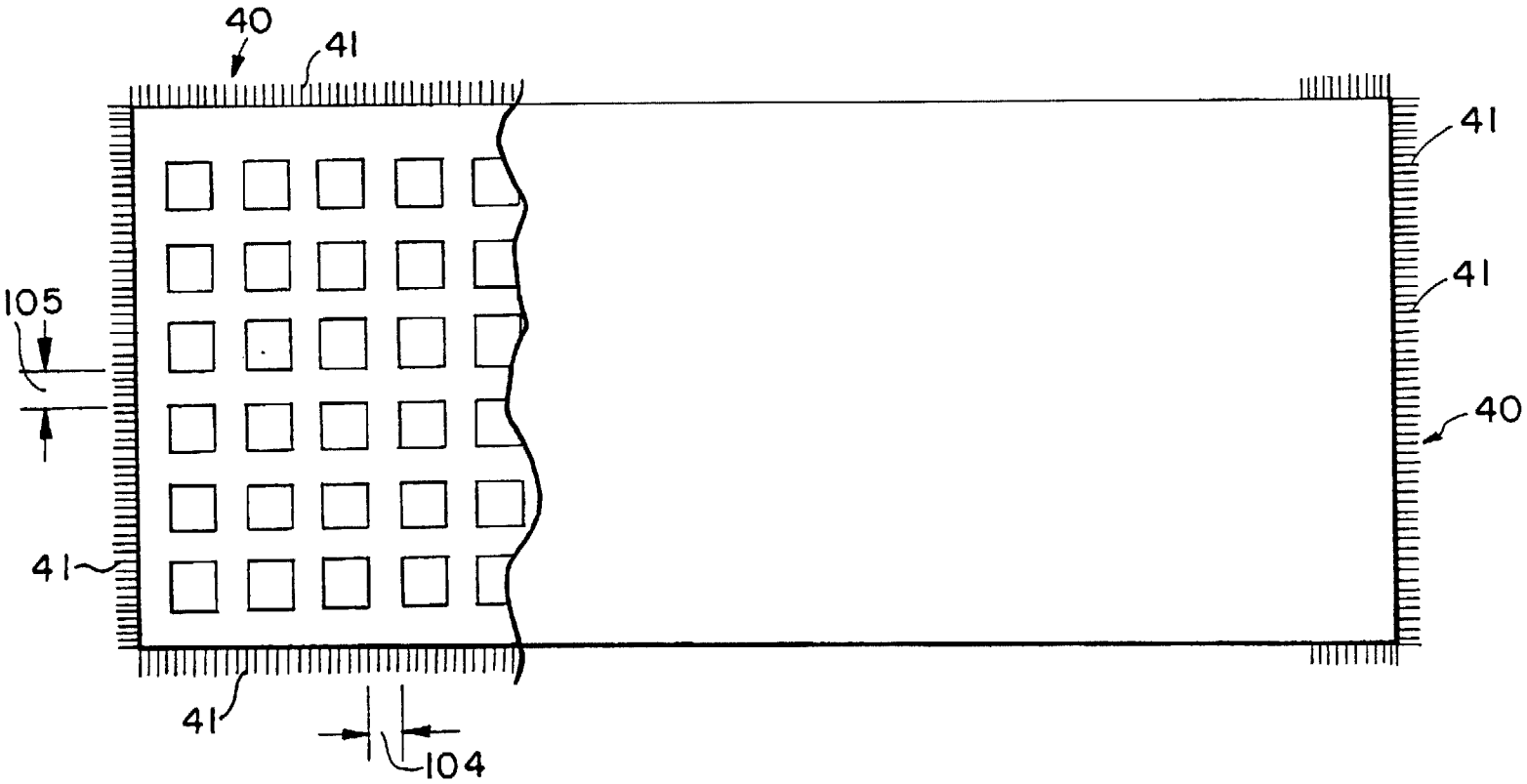
FIG. 3 is an orthogonal view of the bottom surface of the housing which forms the chamber of the wallboard sander, in part showing its relationship to the abrasive sanding screen held against it in accordance with the invention.
Figure 6A:
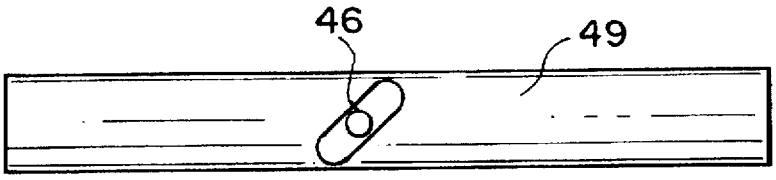
FIGS. 6*a* and 6*b* are illustrations helpful in an understanding of a manner of securing the abrasive sanding screen in position.
Figure 6B:
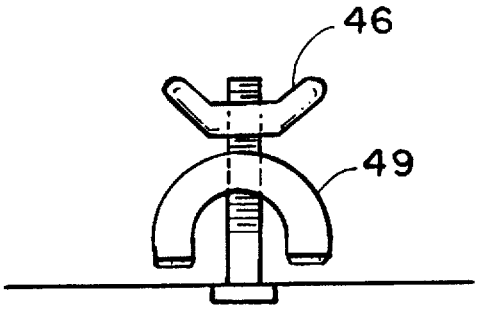

Overlying the bottom surface 16 and these apertures 35, according to the invention, is an abrasive sanding screen 40 (FIG. 3), of a metallic mesh construction of given size interstices 41 which are many times smaller than the apertures 35 of the bottom surface 16. Held in place against the bottom surface 16 in any available manner—such as by a wing-nut tightener 46 (FIGS. 1 and 2) at each side surface 18, the metallic mesh construction acts as an abrasive—just as does a sheet of sandpaper—in smoothing, and thereby removing, spackle and other dry wallboard compounds forming a residue at ceiling or vertical wall constructions. With the grid of many times larger bottom surface perforations 35, on the other hand, any dust generated during a dry wall sanding operation thus falls through the myriad number of bottom surface apertures 35, and into the housing 12 to be collected in the chamber formed by its various surfaces. In a preferred construction of this embodiment, a bottom surface 16 composed of a resilient material was found to be particularly advantageous, in providing a cushion to the abrasive sanding screen when employed in contact therewith. As will be appreciated, tightening the wing-nut 46 fastens a shield 49 to hold the sanding screen in place at the side surface 18, while loosening the wing-nut permits the abrasive sanding screen to be thereafter removed for cleaning or replacement (see FIGS. 6*a* and 6*b*).

As will thus be appreciated, when orienting the wallboard sander of the invention in the manner shown in FIG. 2, any dust particles which would fall by gravity when sanding a dry wallboard ceiling thus pass the mesh interstices 41 and fall through the bottom surface apertures 35 into the chamber formed by the housing 12, to be collected thereby. When it is then desired to empty the chamber, the sander 10 can be tilted by rotating the housing 12 in a counterclockwise manner from the position shown in FIG. 2, so that the cover 28 then points towards the ground. Hinging open the cover 28 then allows the dust residue to be deposited simply into the trash. In this manner, even without a vacuum type attachment of the kind known in the prior art with electric sanders, the dust generated during the sanding operation is collected within the housing 12, instead of falling onto the user, his or her clothing, the floor, carpeting, furniture or otherwise.

Figure 4:
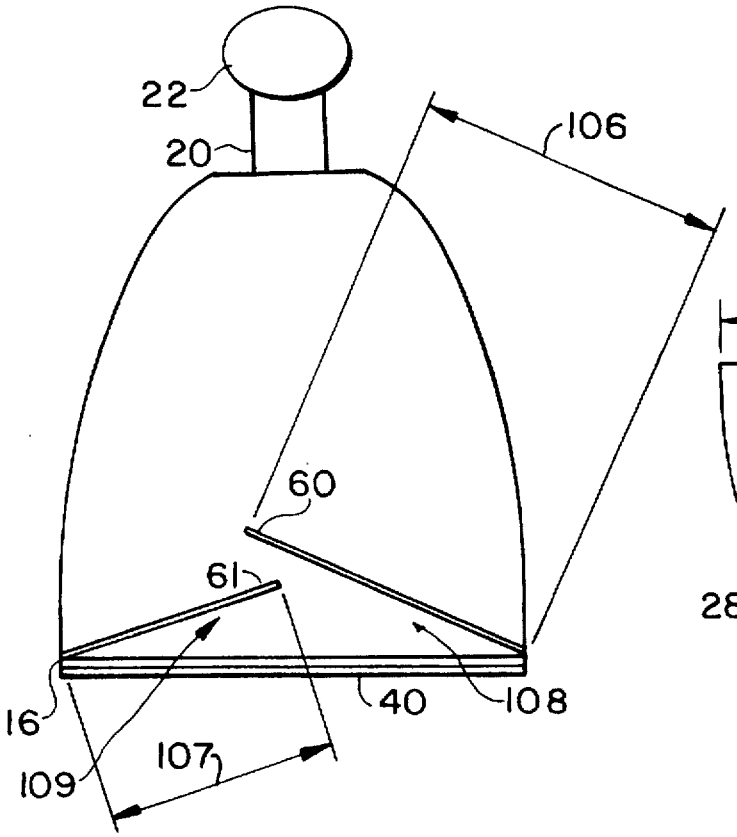
FIG. 4 is a sectional side view of the housing of the sander with its different angled surfaces (or flaps), of different lengths, to aid in preventing spillage of collected dust particles.

In the preferred construction of the invention, furthermore, an arrangement is provided to reduce any propensity for the collected dust to fall back out through the apertures 35 in the event that after its use, the sander is inadvertently tilted or carried so that the apertures 35 point toward the ground, as in FIG. 1. To reduce such possibility, internally of the housing 12, and as shown in the side sectional view of FIG. 4, a pair of surfaces, or flaps, are added. Two such flaps 60, 61 are shown in FIG. 4 to this end, both angled upwardly from opposite ends of the bottom surface 16 of the housing, and extending towards the opposing top surfaces of the housing. As illustrated, more specifically, one of such included surface 60 extends upwardly from the bottom surface 16 at an angle greater than does the other of the pair of included surfaces 61—and, at the same time, with the surface 60 being of greater length than that of the surface 61. As will be appreciated, the overlapping of the two surfaces (or flaps) which result act in a direction so that any dust that might otherwise fall back out through the apertures 35 are restrained to one side of the housing 12 when falling onto the surface 60, and at the other side of the housing, when falling on the surface 61, both of which surfaces extend throughout the length of the housing. Thus, even when the wallboard sander is carried in a downward manner as in FIG. 1, the collected dust captured within the chamber is restricted from falling to the ground, until the cover 28 is adjusted to expose the aperture 26 beneath it, in intended emptying of the wallboard sander.

While Applicant does not wish to be limited to any particular set of values, the following have proven useful in one embodiment of the invention:

| | |
|---|---|
| Dimension 100 | 4 ½ inch |
| Dimension 101 | 9 ¼ inch |
| Dimension 102 | 3 ¼ inch |
| Dimension 103 | 1 ½ inch |
| Dimension 104 | 3/16 inch |
| Dimension 105 | 3/16 inch |
| Dimension 106 | 2 ½ inch |
| Dimension 107 | 1 ⅝ inch |
| Angle 108 | 20 degrees |
| Angle 109 | 15 degrees |
| Dimension 110 | 1 ½ inch |
| Dimension 111 | 1 ½ inch |
| Dimension 112 | 1 inch |
| Dimension 113 | 1 inch |

with the apertures 35 being selected ¼ inch square.

While there have been described what are considered to be preferred embodiments of the present invention, it will be readily apparent to those skilled in the art that modifications can be made without departing from the scope of the teachings herein. For at least such reason, therefor, resort should be had to the claims appended hereto for a true understanding of the scope of the invention.

I claim:

1. A wallboard sander comprising:

a housing having opposing top and bottom surfaces, and a pair of opposing side surfaces forming a dust collecting chamber;

a handle extending upwardly from, and cooperating with, said top surface of said housing for carrying said housing from place-to-place, and for tilting and orienting said housing for use;

an abrasive sanding screen; and first means of each of said opposing side surfaces for securing said abrasive sanding screen below said bottom surface of said housing; and wherein said bottom surface includes a grid of apertures about said bottom surface and between edges defining the shape thereof, of predetermined size, predeterminedly spaced about said bottom surface of said housing and wherein said housing also includes a pair of surfaces inwardly of said dust collecting chamber, angled upwardly from opposite ends of said bottom surface of said housing, and extending towards said opposing side surfaces of said housing.

2. The wallboard sander of claim 1 wherein said first means on each of said opposing side surfaces releasably secure said abrasive sanding screen below said bottom surface of said housing.

3. The wallboard sander of claim 1 wherein there is also included second means on one of said pair of opposing side surfaces of said housing for obtaining access into said housing to empty any dust collected within the chamber formed thereby.

4. The wallboard sander of claim 3 wherein said second means includes an aperture in one of said pair of opposing side surfaces, and a cover to open and close over said aperture as desired.

5. The wallboard sander of claim 4 wherein said second means includes a cover hingeable to open and close over said aperture in use.

6. The wallboard sander of claim 4 wherein except for said aperture in said side surface, said top and said side surfaces of said housing are devoid of any perforations therein.

7. The wallboard sander of claim 1 wherein said bottom surface of said housing is composed of a resilient material providing a cushion to said abrasive sanding screen when in contact therewith.

8. The wallboard sander of claim 1 wherein said handle is spaced apart from said top surface of said housing along its length for permitting grasping thereof in use.

9. The wallboard sander of claim 8 wherein said handle includes a receptacle, angled upwardly from said handle, for receiving an extension pole inserted therein.

10. The wallboard sander of claim 1 wherein said abrasive sanding screen is of a metallic mesh construction of given size interstices, and wherein said bottom surface includes a plurality of apertures of size many times greater than that of said mesh interstices.

11. The wallboard sander of claim 1 wherein one of said pair of included surfaces extends upwardly from said bottom surface of said housing at an angle greater than does the other of said pair of included surfaces.

12. The wallboard sander of claim 11 wherein said one of said pair of included surfaces is of greater length than said other of said pair of included surfaces.

13. The wallboard sander of claim 2 wherein said first means on each of said opposing side surfaces includes a wing-nut for alternately tightening and loosening said abrasive sanding screen in use.

* * * * *